US005385310A

United States Patent [19]

Tholander

[11] Patent Number: 5,385,310

[45] Date of Patent: Jan. 31, 1995

[54] THREAD FEED DEVICE

[75] Inventor: Lars H. G. Tholander, Ulricehamn, Sweden

[73] Assignee: Iro AB, Ulricehamn, Sweden

[21] Appl. No.: 721,430

[22] Filed: Jun. 28, 1991

[30] Foreign Application Priority Data

Dec. 31, 1988 [SE] Sweden ..... 8900006

[51] Int. Cl.[6] ..... B65H 51/20

[52] U.S. Cl. ..... 242/47.01

[58] Field of Search ..... 242/47.01, 47.08, 47.09, 242/47.12, 47.13, 45; 139/450, 452; 226/108; 66/132 R, 132 T

[56] References Cited

U.S. PATENT DOCUMENTS

| | | | |
|---|---|---|---|
| 3,491,963 | 1/1970 | Schlumpf | 242/47.01 |
| 3,528,622 | 9/1970 | Schmidt | 242/47.01 |
| 3,672,590 | 6/1972 | Rosen | 242/47.12 |
| 3,831,873 | 8/1974 | Bense | 242/47.01 X |
| 4,004,438 | 1/1977 | Raisin | 242/47.01 X |
| 4,351,492 | 9/1982 | Aoyama et al. | 242/47.01 X |
| 4,403,634 | 9/1983 | Jankovsky et al. | 242/47.01 X |
| 4,669,677 | 6/1987 | Roser et al. | 242/47.01 |

FOREIGN PATENT DOCUMENTS 2156867 10/1985 United Kingdom .

*Primary Examiner*—Stanley N. Gilreath

*Attorney, Agent, or Firm*—Flynn, Thiel, Boutell & Tanis

[57] ABSTRACT

In a thread feed device for a textile machine, in particular for an air-jet weaving machine, which comprises a thread storage and feed device between a thread supply device and the picking device of the textile machine and which further comprises an assistant device arranged in the thread path extending from the thread supply device to the thread storage and feed device, the assistant device is provided with a friction drive for the thread. A method of driving a thread comprises the features that, in a friction drive constituting the assistant device, the circumferential speed of the friction drive is controlled such that it is higher or lower than the thread speed in the thread storage and feed device, and that, on the circumference of the friction drive, the thread is fed with a certain amount of slip maintained during the feed process or decelerated.

18 Claims, 1 Drawing Sheet

THREAD FEED DEVICE

This application is a continuation of PCT Application No. PCT/EP89/01618, filed Dec. 29, 1989.

FIELD OF THE INVENTION

The present invention is directed to a thread feed device and, more particularly, to a thread feed device having an assistant device provided with a slip friction drive roller for acting on a thread.

BACKGROUND OF THE INVENTION

In the case of a thread feed device which is known from Belgium Pat. No. 900 041, an air jet located close to the thread supply device serves as an assistant device, which, either alone or in cooperation with an arm which is adapted to be resiliently pivoted transversely to the thread path, tries to keep small thread tension variations for the thread storage and feed device during each thread draw-off cycle. Thread tension variations also result from the cyclically changing unwinding paths of the thread from the supply device which has the form of a bobbin. More specifically, the thread is stored on the supply bobbin with a criss-cross winding formation, and the unwinding of the thread in an axial direction periodically changes the direction of the path along which the thread leaves the bobbin thus creating oscillating variations of the resistance of the yarn. The assistant device takes over part of the drawing-off work of the thread storage and feed device. In particular, in the case of the high thread speeds in air-jet weaving machines, a reduction of the number of thread breakages is thus aimed at. However, the air jet and the pivotable arm represent a source of malfunction in the thread path, since it is difficult to exactly adapt the influence of the pneumatic assistant device on the thread to the speed of the thread in the thread storage and feed device.

The present invention is based on the task of providing a thread feed device and a method by which the number of thread breakages in general, and the number of thread breakages in the thread storage and feed device in particular, can be reduced even further.

A friction drive acting on the thread mechanically and with a certain amount of slip (slip-feed) is able to adjust, with the aid of an assist feed, the thread speed upstream of the thread storage and feed device sensitively enough to avoid undesirably strong strains on the thread in the thread storage and feed device. This results in a considerable decrease in thread breakages in general and in thread breakages in the thread storage and feed device in particular. The friction drive can be adapted to the drawing-off speed of the thread storage and feed device in a simple manner. It also damps tension peaks resulting from the changing unwinding paths of the thread (short-time thread drag) from the bobbin. The friction drive has a simple structural design, it requires little space and it can easily be adapted to various thread qualities. The surface, which is in contact with the thread, must not be sticky, but it should be comparatively smooth, it should guarantee gentle treatment of the thread and, moreover, it should be resistant to wear. A rotating surface made of hard chromium-plated aluminum or a surface made of plasma-coated ceramics, for example, will serve this purpose well.

The modulation of the influence on the thread permits a precise adaptation to the respective thread speed, e.g. by selecting the rotating surface of the friction drive.

The drive provides energy for the thread; depending on the thread tension, the thread takes up the amount of energy required for obtaining the necessary thread speed. The major part of this task no longer has to be fulfilled by the thread storage and feed device. A modulation of the influence on the thread can also be effected by influencing the driving force transmission in the friction drive.

The influence on the thread can be modulated by varying the looping angle of the thread in the friction drive, a larger looping angle causing a stronger assist feed, whereas a smaller looping angle causes a weaker assist feed. In addition to the tension of the thread, the looping angle is used as a control variable for the amount of slip.

When the looping angle is approx. 90°, there will be the additional advantage that the thread deflection from the bobbin to the storage device, which has hitherto been necessary in the case of a conventional arrangement of a vertical bobbin and of a horizontal thread storage and feed device, will be carried out by the friction drive itself. The friction roll can be light and its inertia can be small and it can rapidly be accelerated to the speed required and then be decelerated again. Short-time thread drags originating from the bobbin are compensated for by the friction roll.

A clutch member has the effect that the thread can run with the friction roll also without direct drive of said friction roll, if this is advantageous under certain operating conditions. In particular in the slow-down phase, the thread is accurately decelerated via the engaged clutch and the decreasing driving speed, and this prevents, at least to a large extent, after-running of the thread due to its mass and, consequently, an undesirable excessive supply of thread.

A brake member can be used for rapidly decelerating the friction roll or for decelerating said friction roll in a purposeful and modulated manner during operation, a desired thread tension being thus produced. If desired, a free wheel blocking in one direction can be provided as well.

A specially selected surface coating of the friction roll is one of the factors determining the amount of slip. In adaptation to the thread quality, different surface coatings can be provided in an axially juxtaposed mode of arrangement, the respective adequate surface coating being then used in each case.

A speed control unit effects an accurate control of the friction drive in response to the thread speed determined by the thread storage and feed device. It is, however, also possible to drive the friction drive independently and to control the actual speed of the thread only via the modulation of the influence, e.g. by means of the slip. Also particularly sensitive or weak threads can thus be processed at high speeds and without any risk of breakage.

It is possible to achieve a uniform adaptation of the thread speed for the thread storage and feed device. Even in the case of high speeds and a comparatively sharp deflection, the thread will no longer break in the thread storage and feed device. The intentionally effected speed difference causes the slip, which is required for the assist feed (deceleration or acceleration).

From the point of view of control technology, the feed is effected with an increasing amount of slip from the very beginning.

The operating range is subdivided into a plurality of successive ranges. In the first range, the thread is—e.g. in the slow-down phase of the thread storage and feed device—decelerated for the purpose of preventing after-running because the friction drive runs less fast than the thread or stands still. In the next range, the friction drive can be disconnected from its drive, the thread is then subjected to the mechanical motion resistance of the friction drive, and this suppresses variations in the tension. In the subsequent range, a surplus speed is available due to the fact that the friction drive is driven faster than the thread, and, if necessary, the thread will take up said surplus speed at least partially with a certain amount of slip. Also in this speed range variations of the tension in the thread are suppressed by means of the exactly controllable assist feed.

The assist feed decelerates in the range of low thread speeds, whereas it pushes from behind in the case of higher thread speeds.

BRIEF DESCRIPTION OF THE DRAWINGS

Embodiments of the subject matter of the invention are explained on the basis of the drawings, in which.

DETAILED DESCRIPTION

Figure 1:
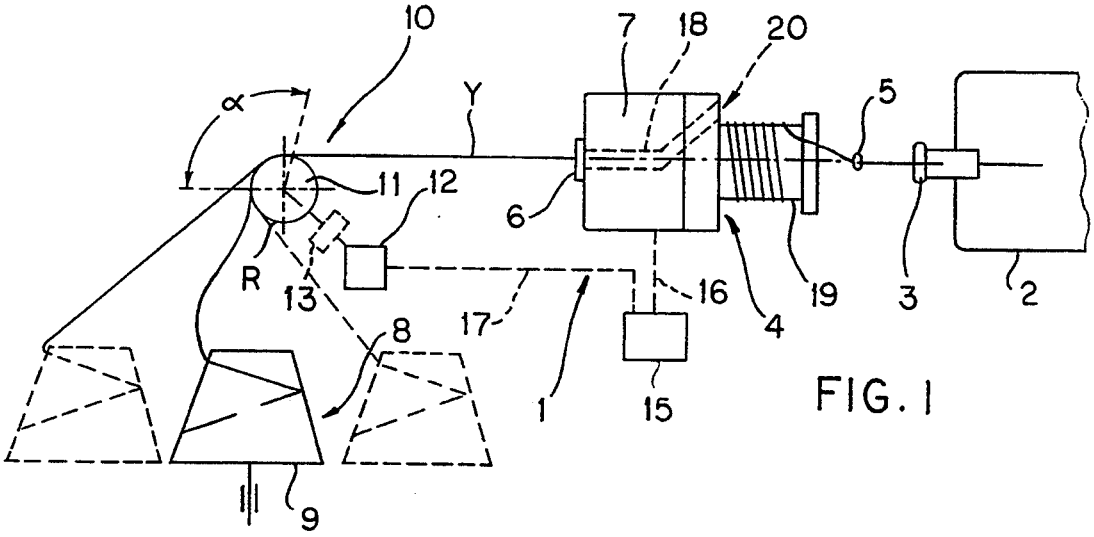
FIG. 1 shows a schematic representation of a thread feed device provided with an assistant device.

In the case of a feed device 1 for feeding a thread Y to a textile machine 2, e.g. to an air-jet weaving machine, a picking device 3, e.g. an air jet, for the textile machine is provided. The picking device 3 is preceded by a thread eyelet 5 and by a thread storage and feed device 4, which, in cases in which a pick of exactly measured length sections is to be processed, can be provided with a measuring device for the respective pick length supplied. An additional thread guide 6 is provided upstream of the thread storage and feed device 4. A drive motor 7 of the thread storage and feed device, which is connected to a control means (not shown), drives a winding element 18 winding the thread Y onto a storage surface 19. In the case of this type of thread storage and feed devices 4, a significant deflection of the thread occurs in the area 20, and this deflection may cause thread breakage in the case of high thread speeds.

The thread Y comes from a thread supply device 8, e.g. from a conical bobbin 9, which has wound thereon said thread, e.g. such that the thread is cross-wound in alternating directions. An assistant device 10 is arranged between the bobbin 9 and the thread guide 6; it will be expedient when said assistant device 10 is arranged close to the bobbin 9. The assistant device 10 is a friction drive R with a friction roll or roller 11 having e.g. a frictionally active surface. The friction roll 11 is drivingly connected to an adjustable drive 12, e.g. a stepping motor. The control of the drive 7 of the thread storage and feed device 4 is connected to a control unit 15 via a line 16, said control unit 15 receiving information on the thread speed. Also the drive 12 can be connected to the control unit 15 via a line 17.

Unless a direct driving connection is provided, a clutch member 13, which is adapted to be disengaged and engaged in a controlled fashion and which, if necessary, is adapted to be modulated, can be inserted between the drive motor 12 and the friction roll 11, said clutch member 13, when disengaged, permitting the friction roll 11 to rotate faster or less fast than the drive motor 12. In addition, a modulable braking device (not shown) for the friction roll 11 may be provided as well. If desired, the clutch member 13 may in this case be replaced by a freewheel which blocks only in the driving direction. More specifically, the freewheel acts as a clutch which transfers torque in only one direction and allows for free running in the opposite direction.

The bobbin 9 is arranged in an upright position, whereas the thread storage and feed device 4 is arranged in an approximately horizontal position. At the friction roll 11, the thread Y is deflected such that a looping angle $\propto$ of approx. 90° is formed. The angle $\propto$ can be adjusted by positioning the bobbin 9 relative to the friction roll 10 as shown in FIG. 1.

The picking device 3 draws thread sections having e.g. a precisely predetermined length off the thread storage and feed device 4. Depending on the amount of thread consumed by the textile machine 2, the drive motor 7 continuously maintains a thread supply in the thread storage and feed device 4 and draws the thread Y off the bobbin 9. This is done in such a way that the thread runs practically continuously. A certain unwinding resistance as well as possible tension peaks in the case of changes in the unwinding paths (short-time thread drag) are opposed to the removal of the thread Y from the bobbin 9.

The assistant device 10 assists in supplying the thread Y at the speed required by the thread storage and feed device or it decelerates the thread in such a way that changes in the tension of the thread Y are limited to small changes. Tension variations caused by a change in the winding direction (short-time thread drag) on the bobbin 9 are compensated for or filtered out by the assistant device 10, thus, in the thread deflection area 20 of the device 4, the tension variations are hardly noticeable.

The exact control of the drive motor 12 and of the friction roll 11, respectively, in response to the thread speed in the thread storage and feed device 4 is particularly important, since the speed influence (friction) occurring when the thread is sharply deflected, e.g. at the outlet of the winding element 18, is thus eliminated. In order to sum up, it can be said that excessive thread tension and dangerous variations in the tension in area 20 are largely avoided by the assist feed, i.e. factors are avoided which were presumably the cause of thread breakage occurring in said area.

In FIGS. 2-4*b*, VR represents the circumferential speed of the friction roller, i.e. the direction in the diagram in which the circumferential speed of the friction roller increases. VY represents the direction in which the yarn speed increases in the diagram. KR and KY represent the speed curves of the circumference of the friction roll and the yarn, respectively.

Figure 2:
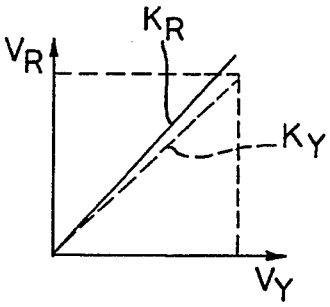
FIG. 2 shows in the form of a diagram a thread speed curve.

According to FIG. 2, the thread speed KY remains below the circumferential speed KR of the friction drive throughout the whole operating range. Both speed curves are shown in idealized form as straight lines having different slopes. A slip, which increases in proportion to an increase in the thread speed, occurs between the thread and the friction drive so that the friction drive can always push the thread from behind if this should be required by the thread storage and feed device 4.

Figure 3:
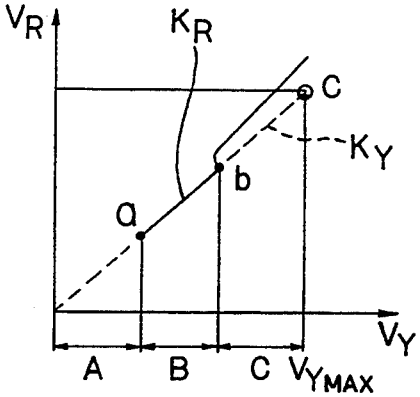
FIGS. 3, 4*a*, and 4*b* show various speed diagrams.

According to FIG. 3, the operating range of the thread storage and feed device 4, i.e. the curve KY of the thread speed VY, is subdivided into three sections A, B, C. Section A extends up to a comparatively low speed reference value a; section B extends from a up to a higher speed reference value b; section C extends from b up to the highest speed reference value c (maximum thread speed value VYmax). In section A the thread is decelerated by the friction drive which can even stand still. The clutch is engaged in this case. This is particularly important in the slow-down phase. In section B the clutch is disengaged. The friction drive rotates freely together with the thread; due to the rotational resistance of the friction drive, slip will occur. In section C the friction drive is driven with a positive speed surplus, the clutch is engaged. The thread is fed with a certain amount of slip. When the thread tension increases, the slip will decrease and the assist feed will increase and vice versa. The tension is again maintained comparatively low and uniform. An unsteady speed curve KR is obtained for the friction drive, the curve KR in FIG. 3 being exaggerated or rather idealized.

Figure 4A:
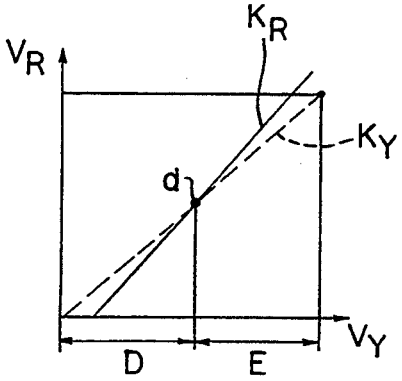
Figure 4B:
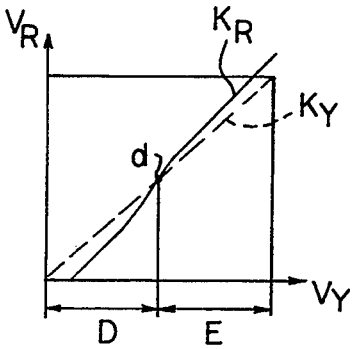

According to FIG. 4*a*, 4*b* a reference speed value d along the curve KY has been chosen, e.g. depending on the thread quality, so that two sections D, E exist. When the thread speed VY increases, the friction drive will be driven less fast than the thread in section D until the friction drive curve KR will cross the curve KY at point d. In section E the friction drive is driven with an increasing speed surplus. The curve KR can, in an idealized form, be a straight line (FIG. 4*a*) or a shallow S-curve (FIG. 4*b*) having its inflection point at point d. Under special operating conditions, the friction drive may also be driven in a direction opposite to the direction of movement of the thread for intentionally causing even stronger deceleration.

Control unit 15 processes signals representing the size of the yarn store on the storage surface 19. The control unit drives the winding element 18 via drive motor 7 in order to either replenish the yarn store on the storage surface or to maintain its size within given limits. The control unit 15 establishes an essentially average driving speed to avoid a stop-go operation with harsh accelerations and decelerations. The information signal for controlling the drive motor 7 in the feeding device is also used for controlling drive motor 12 accordingly and in synchronism with the drive motor 7 to enable the assistant device 10 to present the yarn to the feeding device at the demanded speed. For example, for a pattern of the weaving machine needing many yarn sections of the yarn from the feeding device 4 within a given period of time, the control device 15 accelerates the drive motor 7 in order to maintain a given storage size on the storage surface 19 even for the high insertion frequency. When the pattern changes, for only yarn sections per time unit, the yarn store on the storage surface 19 would become overfilled, but then the control unit 15 reduces the speed of drive motor 7 accordingly, and also the speed of the drive 12.

In order to avoid after-running or ballooning of a previously fast-running yarn in a slow-down phase, drive 12 can be controlled by control unit 15 to intentionally brake the yarn as illustrated in section A of FIG. 3. In acceleration phases, the friction roller 11 has to be driven with over-speed. In constant speed phases, the friction roller 11 may run freely so as to be dragged by the yarn. In slow-down phases, the friction roller 11 may be stopped or braked as in section A of FIG. 3 in order to intentionally decrease the yarn speed and to maintain the yarn tension at a low but constant level.

I claim:

1. In a thread feeding system for a textile machine, such as an airjet weaving machine, the feeding system including a thread storage and feed device positioned between a thread supply device and a picking device of the textile machine, and an assistant device positioned in the thread path extending from the thread supply device to the thread storage and feed device, comprising the improvement wherein the assistant device includes a drivable slip friction roller having a peripheral surface on which thread running from the thread supply device to the thread storage and feed device is deflected and conveyed by a friction force directed circumferentially along said peripheral surface with a modulable slip-effect.

2. The thread feeding system claimed in claim 1, wherein the assistant device further includes drive means for driving said slip friction roller.

3. The thread feeding system claimed in claim 2, wherein said drive means is a speed-adjustable drive.

4. The thread feeding system claimed in claim 3, wherein the assistant device further includes a clutch member interposed between said slip friction roller and said drive means to disengage or modulate the speed of said slip friction roller.

5. The thread feeding system claimed in claim 3, wherein axially delimited surface coatings causing different degrees of slip-effect are positioned side by side on said peripheral surface of said slip friction roller.

6. The thread feeding system claimed in claim 3, further including a speed control unit connected to a drive motor of the thread storage and feed device and connected to said drive means of said assistant device, said speed control unit including means for controlling said drive means in response to the speed of the thread in the thread storage and feed device.

7. The thread feeding system claimed in claim 1, wherein said peripheral surface of said slip friction roller has a contacting area of predetermined circumferential length for contacting the thread, and wherein means are provided for varying the length of said contacting area for modulating the slip-effect.

8. In a thread feeding system for a textile machine, the thread feeding system including a thread storage and feed device positioned between a thread supply device and a picking device of the textile machine, and an assistant device interposed between the thread supply device and the thread storage and feed device along a thread path, comprising the improvement wherein the assistant device includes a drivable slip friction roller having a peripheral surface on which a thread running from the thread supply device to the thread storage and feed device is deflected, and means for controlling a peripheral surface speed of said slip friction roller so that said peripheral surface speed deviates from a thread speed in the thread storage and feed device to maintain a predetermined amount of slip with the thread where it contacts said peripheral surface during a thread feeding operation.

9. The thread feeding system claimed in claim 8, wherein said slip is defined as a speed differential between said peripheral surface speed and said thread speed, and said slip increases approximately continuously in proportion to an increase in said thread speed.

10. The thread feeding system claimed in claim 8, wherein said assistant device further includes a speed-adjustable drive motor for driving said slip friction drive roller.

11. The thread feeding system claimed in claim 10, wherein said means for controlling said peripheral surface speed includes a speed control unit connected to said drive motor and connected to a second drive motor of the thread storage and feed device, said speed control unit including means for controlling said first-mentioned drive motor in response to the thread speed in the thread storage and feed device.

12. The thread feeding system claimed in claim 11, wherein the thread speed in the thread storage and feed device varies in a predetermined range up to a maximum thread speed value, said range having a plurality of reference thread speed values which are utilized as switching points for said speed control unit, said means for controlling said first-mentioned drive motor including means for forcibly decelerating said slip friction drive roller in a first range delimited by a first reference speed value, means for disconnecting said slip friction drive roller from said first-mentioned drive motor so that said slip friction drive roller operates in a freely rotatable manner together with the thread in a second speed range delimited by said first reference speed value and a second reference speed value which is greater than said first reference speed value, and means for driving said slip friction drive roller with a positive speed differential which increases in proportion to an increase in the thread speed and which feeds the thread with a predetermined amount of slip in a third speed range delimited by said second reference speed value and said maximum thread speed value.

13. The thread feeding system claimed in claim 11, wherein the thread speed in the thread storage and feed device varies in a predetermined range up to a maximum thread speed value, said range having a reference speed value which is indicative of thread quality, said means for controlling said first-mentioned drive motor including means for driving said slip friction drive roller slower than the thread speed up to said reference speed value, and means for driving said slip friction drive roller increasingly faster than the thread speed above said reference speed value, a curve representing said slip friction drive roller speed defining an approximately straight or a shallow S-curve which crosses the thread speed curve.

14. The thread feeding system claimed in claim 10, wherein said drive motor is a stepping motor.

15. The thread feeding system claimed in claim 8, wherein the assistant device further includes means for modulating said peripheral surface speed to vary said predetermined amount of slip.

16. The thread feeding system claimed in claim 15, wherein said means for modulating includes a clutch member for engaging and disengaging said slip friction drive roller from a drive motor.

17. The thread feeding system claimed in claim 15, wherein said peripheral surface has a contacting area of predetermined circumferential length, and wherein said means for modulating includes means for varying said circumferential length to modulate the amount of slip.

18. The thread feeding system claimed in claim 15, wherein said means for modulating includes axially delimited surface coatings positioned side by side on said peripheral surface which cause differing amounts of slip.

* * * * *

UNITED STATES PATENT AND TRADEMARK OFFICE

CERTIFICATE OF CORRECTION

PATENT NO. : 5 385 310

DATED : January 31, 1995

INVENTOR(S) : Lars Helge Gottfrid THOLANDER

It is certified that error appears in the above-indentified patent and that said Letters Patent is hereby corrected as shown below:

On the title page insert below item [22], before item [30]

---[63] This application is a continuation of PCT Application No. PCT/EP89/01618, filed December 29, 1989.---

Signed and Sealed this

Twenty-seventh Day of June, 1995

*Attest:*

Bruce Lehman

BRUCE LEHMAN

*Attesting Officer*

*Commissioner of Patents and Trademarks*